US010577987B2

(12) United States Patent
Teake de Jong et al.

(10) Patent No.: US 10,577,987 B2
(45) Date of Patent: Mar. 3, 2020

(54) COMBUSTION ENGINE

(71) Applicant: Finvestor B.V., Utrecht (NL)

(72) Inventors: Arjen Teake de Jong, Barneveld (NL); Sjouke Kemp de Jong, Barneveld (NL); Richard Theodoor Breunesse, South Lyon, MI (US); Jacob Theodorus Krijgsman, Utrecht (NL)

(73) Assignee: Finvestor B.V., Utrecht (NL)

( * ) Notice: Subject to any disclaimer, the term of this patent is extended or adjusted under 35 U.S.C. 154(b) by 0 days.

(21) Appl. No.: 16/167,923

(22) Filed: Oct. 23, 2018

(65) Prior Publication Data

US 2019/0153912 A1 May 23, 2019

(30) Foreign Application Priority Data

Oct. 23, 2017 (NL) ..... 2019783

(51) Int. Cl.

| | |
|---|---|
| ***F01L 7/14*** | (2006.01) |
| ***F02M 26/01*** | (2016.01) |
| ***F01L 1/047*** | (2006.01) |
| ***F01L 3/00*** | (2006.01) |

(52) U.S. Cl.

CPC ..... *F01L 7/14* (2013.01); *F01L 1/047* (2013.01); *F01L 3/00* (2013.01)

(58) Field of Classification Search

CPC ..... F02M 26/01; F01L 1/36; F01L 7/14
See application file for complete search history.

(56) References Cited

U.S. PATENT DOCUMENTS

| | | | | | |
|---|---|---|---|---|---|
| 4,237,832 | A | * | 12/1980 | Hartig | F02B 75/02 123/198 F |
| 4,250,850 | A | | 2/1981 | Ruyer | |
| 4,917,054 | A | | 4/1990 | Schmitz | |
| 5,265,564 | A | * | 11/1993 | Dullaway | F02B 33/22 123/560 |
| 5,699,758 | A | | 12/1997 | Clarke | |

(Continued)

FOREIGN PATENT DOCUMENTS

| | | | |
|---|---|---|---|
| DE | 102010025051 | A1 | 12/2011 |
| DE | 102012002026 | A1 | 8/2013 |

(Continued)

*Primary Examiner* — Long T Tran
(74) *Attorney, Agent, or Firm* — Jenkins, Wilson, Taylor & Hunt, P.A.

(57) ABSTRACT

A combustion engine comprises combustion chambers (1-4) with reciprocating pistons (5), intake ports (6) and exhaust ports (7). Overflow ports (11,12) are provided between adjacent combustion chambers to provide an overflow channel (15,16) that closes during a high load mode of operation of said engine and opens during a partial load mode of operation. The overflow ports (11,12) straddle a path of shortest distance between adjacent combustion chambers and said overflow channel (15) extends at least substantially along said path of shortest distance. In a further aspect of the invention, exhaust ports (1*b*+2*a*, 3*b*+4*a*) of adjacent combustion chambers are joined into a common exhaust channel (P2,P4) that communicates with an exhaust header (20) of the engine through valve means (V1,V2) that open during the high load mode of operation of said engine and close during a partial load mode of operation.

15 Claims, 4 Drawing Sheets

(56) References Cited

U.S. PATENT DOCUMENTS

| | | | | |
|---|---|---|---|---|
| 8,082,892 | B2 * | 12/2011 | Zhao | F02B 41/06 123/25 P |
| 8,256,390 | B1 * | 9/2012 | Bonner | F02B 41/04 123/64 |
| 9,739,221 | B2 * | 8/2017 | Madison | F02M 26/04 |
| 2012/0080017 | A1 * | 4/2012 | Phillips | F02B 33/22 123/70 R |
| 2013/0298888 | A1 * | 11/2013 | Fiveland | F02B 33/22 123/70 R |

FOREIGN PATENT DOCUMENTS

| | | | |
|---|---|---|---|
| DE | 102013006703 | A1 | 10/2014 |
| GB | 122635 | A | 2/1920 |
| WO | WO 2017007357 | A1 | 1/2017 |

* cited by examiner

COMBUSTION ENGINE

The present invention relates to a combustion engine, comprising at least a first combustion chamber and a second combustion chamber that are adjacent to one another, said first combustion chamber and said second combustion chamber each having a reciprocating piston, at least one intake port, at least one exhaust port and an overflow port, in which the overflow port of said first combustion chamber and said overflow port of said second combustion chamber are connected with one another through an overflow channel that comprises a valve which closes said overflow channel during a high load mode of operation of said engine and opens said overflow channel during a partial load mode of operation of said engine. The present invention more particularly relates to an internal combustion engine having reciprocating pistons. More specifically, this invention relates to an internal combustion engine having the ability to deactivate combustion chambers for energy efficiency enhancement using the principle of overexpansion.

Currently the internal combustion (IC) engine is by far the predominant type of engine used today for purposes of providing power to propel motorized vehicles, as well as many other forms of transportation and recreation devices. When compared to other forms of automotive power, the internal combustion engine is preferred for high power density, high reliability and convenient energy storage potential that expresses itself as the distance traveled between refueling and refill time. However, concern for preservation of natural resources and for the environment has continuously encouraged efforts to improve the efficiency, performance and fuel economy of IC engines while reducing their harmful emissions and noise.

Various arrangements have been suggested to improve the combustion efficiency of IC engines. One way of improving the efficiency is by deploying combustion chamber deactivation when only a partial load is demanded of the engine. This principle is applied on several production vehicles. A combustion engine of this kind is known from German patent application DE 10 2013 006 703. This document describes a four combustion chamber inline engine in which the centre pair of combustion chambers is deactivated during a partial load mode of operation. These combustion chambers are activated again when the load demand on the engine requires so to gain full power capabilities. To further boost the overall efficiency this known engine moreover gains additional performance from overexpansion of the combustion gasses during partial load to increase efficiency of the engine. To that end the outer combustion chambers, referred to as first combustion chambers, comprise only one exhaust port, while the other exhaust port serves as an overflow port that connect via an overflow channel to a corresponding overflow port on the adjacent one of the centre combustion chambers, referred to as second combustion chambers. These centre combustion chambers communicate to one another through a overflow channel that is provided at the intake side of these combustion chambers by sacrificing one of the intake ports.

During partial load the overflow channels are open to allow overexpansion of the combustion gasses to enter the centre combustion chambers which are now idle. The residual energy stored in the combustion gasses allows these gasses to further expand in the additional volume provided by the centre combustion chambers. This additional expansion is gained as additional efficiency during this mode of operation. On high load, however, the overflow channels are closed by appropriate valves and the centre combustion chambers are activated again to provide full engine power.

In order to improve its overall efficiency, this known engine employs a combination of combustion chamber de-activation and efficiency gain by overexpansion during partial load. During high load, however, this known engine performs far from optimal because the provision of overflow channels require an exhaust port at the outer combustion chamber and an intake port on the centre combustion chamber to be sacrificed. This will inevitably lead to less performance and less efficiency during a high load mode of operation. Moreover, the rerouting of combustion gasses through the overflow ports and corresponding overflow channels adds to the complexity of the engine if done in the manner as described in said German patent application.

It is an object of the present invention to apply the principles of overexpansion and combustion chamber-deactivation in a combustion engine in a manner in which these disadvantages as encountered in the engine of said German patent application are avoided, at least to a significant extent. In a further aspect of the invention, it is an object of the invention to implement both these principles in a combustion engine in a considerably more convenient manner avoiding at least much of the complexity as required in the known engine.

In order to achieve said goal, a combustion engine of the type described in the opening paragraph, according to the invention, is characterized in that said overflow port of said first combustion chamber and said overflow port of said second combustion chamber are at least substantially located at positions that straddle a path of shortest distance between said first combustion chamber and said second combustion chamber, and in that said overflow channel extends at least substantially along said path of shortest distance between said overflow port of said first combustion chamber and said overflow port of said second combustion chamber. The invention is based on the recognition that overflow ports at a shortest distance between the combustion chambers involved will lead to least flow resistance and energy loss of the combustion gasses that are rerouted that way. This will add to the overall efficiency of the engine, particularly during partial load operation.

Although the invention requires two combustion chambers as a minimum to employ both combustion chamber de-activation and rerouting of the exhaust gasses to the idle combustion chamber to allow over-expansion, a particularly practical embodiment of the engine according to the invention, comprising a further first combustion chamber and a further second combustion chamber that are similar to said first combustion chamber and second combustion chamber, said second combustion chamber and said further second combustion chamber each comprising a further overflow port, in which the further overflow port of said second combustion chamber and the further overflow port of said further second combustion chamber are connected with one another through a further overflow channel that comprises a valve which closes said further overflow channel during said high load mode of operation of said engine and opens said further overflow channel during said partial load mode of operation of said engine, is characterized in that said further overflow port of said second combustion chamber and said further overflow port of said further second combustion chamber are at least substantially located at positions that straddle a path of shortest distance between said second combustion chamber and said further second combustion chamber, and in that said further overflow channel extends at least substantially along said path of shortest distance between said further overflow port of said second combustion chamber and said further overflow port of said further second combustion chamber. This embodiment concerns at least four combustion chambers, both first combustion chambers operating in every mode of operation, while both second combustion chambers are deactivated during partial load operation and provide additional expansion capability to the exhaust gasses emanating from the first combustion chambers. The overflow channel between both second combustion chambers allows these combustion chambers to act as a single over-expansion volume.

The switch between 'normal' and 'overexpansion' mode of the engine according to the invention has to happen within one engine rotation. To that end a specific embodiment of the engine according to the invention is characterized in that control means are provided that disable a complete opening of said at least one exhaust port of said first cylinder and said at least one intake port of said second cylinder, while activating said overflow valve of said overflow channel between said first cylinder and said second cylinder within one rotation of said engine.

The intake ports of the combustion chambers as well as their exhaust ports are normally controlled by respective valves that need to be sufficiently fast to open and close on the right instance during each cycle of the engine. In that case, a preferred embodiment of the engine according to the invention is characterized in that said control means comprise a first variable cam shaft and a second variable cam shaft, in that the intake ports of said first combustion chamber and said second combustion chamber comprise timed valves, in particular poppet valves, that are activated within one engine rotation and are controlled by said first variable cam shaft, and in that the exhaust ports of said first combustion chamber and said second combustion chamber comprise timed valves, in particular poppet valves, that are activated within one engine rotation and are controlled by said second variable cam shaft. Both camshafts may be variable by means of for instance an adapted cam profile in combination with hydraulic, mechanical or electronic camshaft shift technology.

Using the same technology, a specific embodiment of the engine according to the invention is characterized in that said overflow valve of said overflow channel comprises a poppet valve that is actuated by a further variable cam shaft. This additional camshaft operates the (poppet) valve(s) in the overflow channels between the primary (first) combustion chamber(s) and the secondary (second) combustion chamber(s) to reroute the exhaust gasses for over expansion during partial load operation. In case of a double overhead cam shaft engine, this overexpansion camshaft may be provided in between the intake camshaft and the exhaust camshaft along the path of shortest distance between the combustion chambers.

Contrary to the valves that control the strokes of the combustion chambers, the valves that reroute the exhaust gasses for overexpansion are maintained in the same state over the entire duration of the respective mode of operation of the engine, i.e. partial load or full load. As a result these valves need not be fast and may be optimized for rerouting. In this respect a specific embodiment of the engine according to the invention is characterized in that said overflow valve of said further overflow channel comprises a slow valve, in particular a plunger or rotating type valve, that is activated or de-activated over consecutive engine rotations.

In a further aspect the invention has for its object to provide a combustion engine that may benefit from overexpansion of the exhaust gasses during partial load operation with a comparably simple layout. To that end, a combustion engine, comprising at least a first combustion chamber and a second combustion chamber, said first combustion chamber and said second combustion chamber each having a reciprocating piston, an intake port and an exhaust port, in which the exhaust port of the first combustion chamber and the exhaust port of the second combustion chamber communicate with an exhaust header of said engine through respective exhaust channels, according to the invention is characterized in that said first and second combustion chamber each comprise a further exhaust port, said further exhaust ports of said first combustion chamber and said further exhaust port of said second combustion chamber communicate jointly in a common exhaust channel, and in that said common exhaust channel communicates with said exhaust header through valve means that open during a high load mode of operation of said engine and close during a partial load mode of operation of said engine. According to this aspect of the invention the exhaust channel in between adjacent combustion chambers is used as an overflow channel between the first combustion chamber and the second combustion chamber. By operation of a suitable valve this overflow channel is opened by closing the exhaust path to the exhaust header during partial load of the engine, or is part of the original exhaust path during full load of the engine. This way an overflow channel is accommodated in a Y-pipe design layout of the exhaust header that leaves the exhaust capabilities substantially uncompromised during full load operation.

Although this Y-pipe design requires two combustion chambers as a minimum to employ both combustion chamber de-activation and rerouting of the exhaust gasses to the idle combustion chamber to allow over-expansion, a particularly practical embodiment of the engine according to the invention, comprising a further first combustion chamber and a further second combustion chamber that are similar to said first combustion chamber and said second combustion chamber, is characterized in that an exhaust port of said second combustion chamber and an exhaust port of said further second combustion chamber communicate together in a further common exhaust channel that connects to said exhaust header of said engine. This embodiment concerns at least four combustion chambers, both first combustion chambers operating in each mode of operation, while both second combustion chambers are deactivated during partial load operation and are used as additional expansion volume for the exhaust gasses emanating from the first combustion chambers.

An overflow channel between both second combustion chambers may allow these combustion chambers to act as a single over-expansion volume. To that end, a further preferred embodiment of the engine according to the invention is characterized in that said second combustion chamber and a further second combustion chamber are connected with one another through an overflow channel that comprises a valve means that close said overflow channel during said high load mode of operation of said engine and that open said overflow channel during said partial load mode of operation of said engine. This overflow channel may remain in an open state throughout the entire duration of a partial load mode of operation of the engine, while closing once full load operation is demanded. In order to optimize the overflow characteristics of said overflow channel, a further specific embodiment of the engine according to the invention is characterized in that said overflow channel extends at least substantially along a path of shortest distance between said second combustion chamber and said further second combustion chamber.

Contrary to the valves that control the strokes of the combustion chambers, the valve means in the overflow channel between both second combustion chambers is maintained in the same state over the entire duration of the respective mode of operation of the engine, i.e. partial load or full load. As a result this valve need not be fast and may be optimized for levelling the overexpanding exhaust gasses over both second cylinders. In this respect a specific embodiment of the engine according to the invention is characterized in that said valve means of said overflow channel comprise a slow valve, in particular a plunger or rotating type valve.

The intake ports of the combustion chambers as well as their exhaust ports are controlled by respective valves that need to be sufficiently fast to open and close on the right instance during each cycle of the engine. To that end, a preferred embodiment of the engine according to the invention is characterized in that the intake ports of said first combustion chamber and said second combustion chamber comprise timed valves, in particular poppet valves, that are activated within one engine rotation and are controlled by a first variable cam shaft, and in that the exhaust ports of said first combustion chamber and said second combustion chamber comprise timed valves, in particular poppet valves, that are activated within one engine rotation and are controlled by a second variable cam shaft. Both camshafts may be variable by means of, for instance, an adapted cam profile in combination with hydraulic, mechanical or electronic camshaft shift technology.

Contrary to the poppet valves that control the intake and exhaust ports of the combustion chambers, the valve means in the exhaust channels between adjacent combustion chambers are maintained in the same state over the entire duration of the respective mode of operation of the engine, i.e. partial load or full load. As a result these valve means need not be fast and may be optimized for exhausting exhaust gasses to the exhaust header during full load operation and to provide a low resistance overflow path between the adjacent cylinders during overexpansion. In this respect a specific embodiment of the engine according to the invention is characterized in that said valve means between said common exhaust channel and said exhaust header comprise a slow valve, in particular a plunger or rotating type valve.

Efficiency optimization during overexpansion to other cylinders is a crucial aspect for practical implementation in road vehicles. Due to the dynamic behaviour of road vehicles one-cycle or less response time is required to avoid drivability compromises. Addition of hybrid-electric drive enhances the need for close to seamless transition between propulsion modes:

Full electric (no combustion engine)

Hybrid drive—overexpansion mode

Overexpansion mode

Full combustion engine operation

Hybrid drive—with full combustion engine operation

Switching between drives with a delay would heavily impact the drivability and 'fun-to-drive' which is a considerable issue in passenger car industry. Any hic-ups, noise or vibration is often perceived as unacceptable. Using the setup of the invention, this is minimized and/or resolved.

Secondly using an optimized routing of the channels, heat loss is minimized, enhancing the efficiency of overexpansion. This extends the operational field in which overexpansion can be applied and, hence, even further improves fuel efficiency Finally optimizing gas rerouting further reduces engine vibrations compared to cylinder de-activation.

The invention will now be described in greater detail with reference to certain exemplifying embodiments along the lines of an accompanying drawing. In the drawing.

Figure 1:
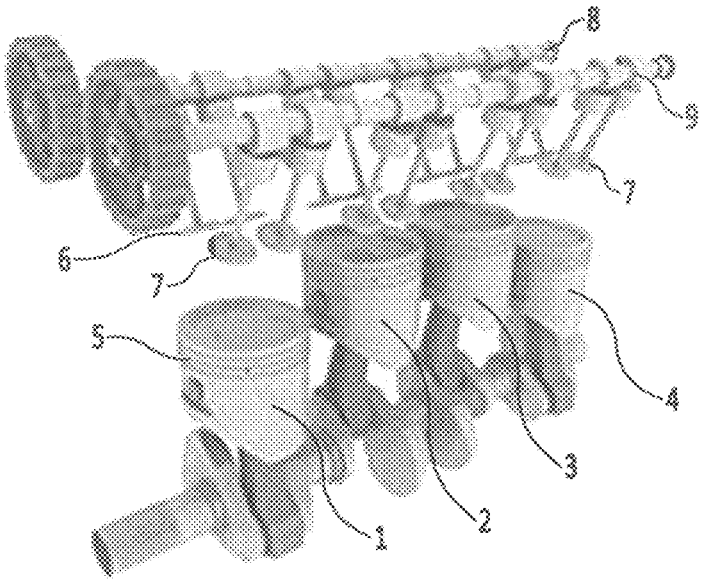
FIG. 1 shows the general internal layout of a conventional combustion engine.

It should be understood that the drawing is purely schematic and not necessary drawn to the same scale. In particular, certain dimension may have been exaggerated to a greater or lesser degree to render the figures more lucid. Same parts are designated by same reference numerals throughout the figures.

FIG. 1 shows a typical 4-cylinder internal combustion engines with four consecutive combustion chambers that are placed inline and comprise the cylinders. Throughout this description the expression "cylinder" and "combustion chamber" may be used alternately as synonyms of one another. This engine typically has a firing order '1-3-4-2'. In practice, however, the firing order may vary without departing from the general principle of the present invention. Cylinders 1 and 4 are in phase with each other and both are 180 degrees out of phase with cylinders 2 and 3, which also move together. For sake of clarity the internal design of the engine is depicted in FIG. 1 showing the pistons 5 that reciprocate within the cylinders. Each cylinder comprises two intake ports that are controlled by intake poppet valves 6 and two exhaust ports that are opened or closed by exhaust poppet valves 7. The intake poppet valves 6 are actuated by an intake camshaft 8, whereas the exhaust valves 7 have a separate overhead exhaust camshaft 9 that actuates these valves. At the lower end the engine comprises a crankshaft 10 that is driven by piston rods extending from the pistons 5 that alternately reciprocate within the cylinders in consecutive strokes of the engine.

During full load operation, normal 4-stroke operation is performed, where each cylinder 1-4 has two intake valves to let air in during the intake stroke and two exhaust valves to remove the combusted gasses from the cylinders during the exhaust stroke. Using traditional poppet valves 6,7 in the cylinder head the exhaust gas of each cylinder is routed to the exhaust system in this 'full power mode' of the engine.

If the engine needs to deliver merely limited power, for instance if the engine runs stationary or at constant moderate speed, the engine management system switches the engine in a corresponding partial load mode of operation. In this mode the inner cylinders 2,3 are deactivated and the engine is merely driven by the primary cylinders 1,4. During cylinder deactivation the deactivated cylinder poppet valves need not used anymore and may also be de-activated by altering the cam profile for this mode. This can be done in various ways by i.e. shifting the camshaft axially, using a conical rotation of the camshaft or using other mechanical or electronic methods such as electromagnetic valve operation.

Figure 2:
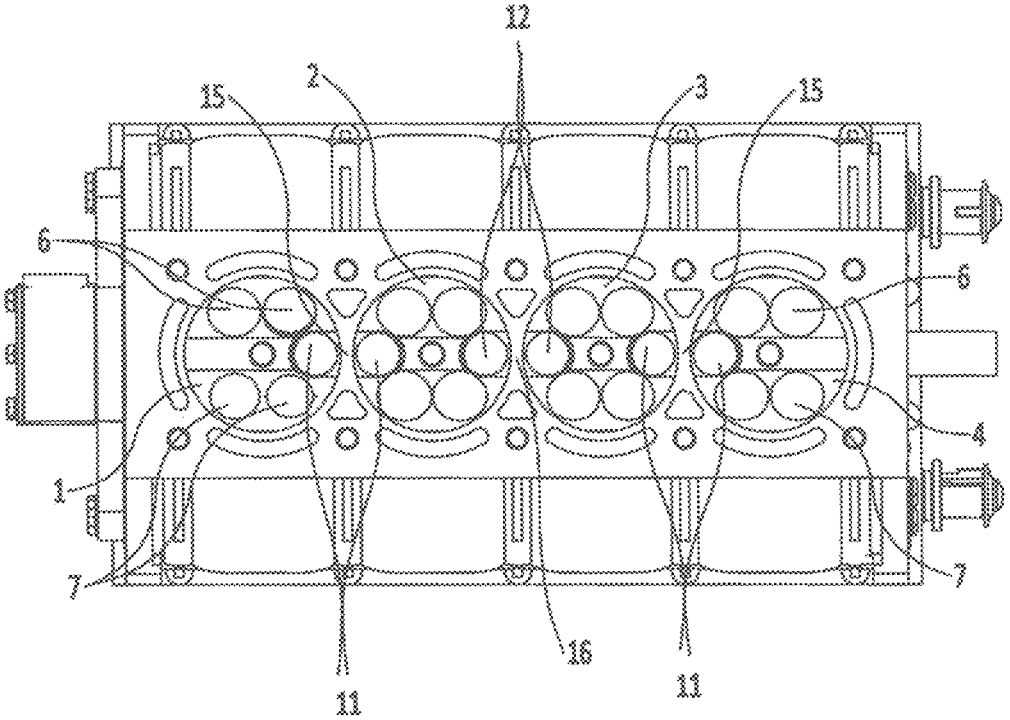
FIG. 2 shows a lateral cross section of an embodiment of a combustion engine according to the invention.

The exhaust gasses leaving the active cylinders 1,4 are rerouted to the passive cylinders 2,3 to allow overexpansion of these gasses in the additional free volume provided by the passive cylinders during said partial load mode of operation. According to a first aspect of the invention a combustion engine is equipped with dedicated overflow ports 11,12 in each combustion engine to optimize such rerouting and hence the engine efficiency during partial load. According to the invention these overflow valves straddle a path of shortest distance 15,16 between adjacent cylinders and an overflow channel between the cylinders is provided at least substantially along this path of shortest distance, see FIG. 2.

Figure 3:
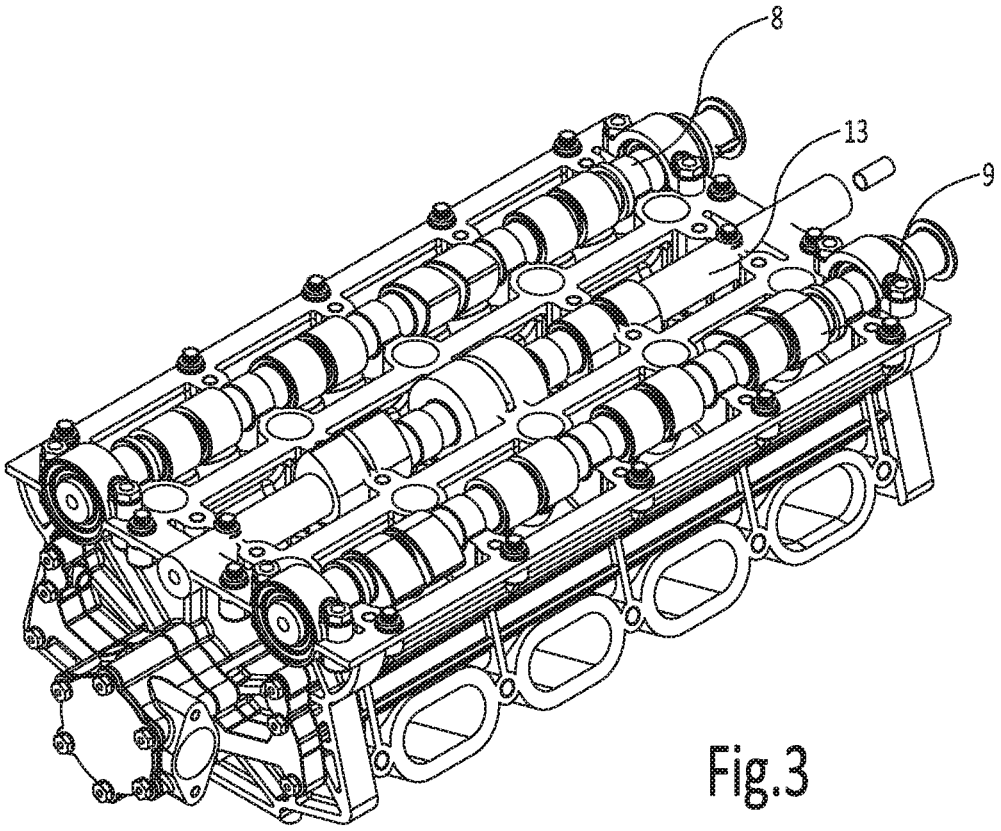
FIG. 3 shows a top view of the combustion engine of FIG. 2.

The overflow ports 11,12 of this example are provided with individual poppet valves. Valve operation is very fast using variable hydraulic/mechanical/electronic camshaft technology. In this example, actuation of the poppet valves that open or close the overflow ports 11,12 is realized by using a separate unique variable camshaft 13, as shown in FIG. 3. This additional camshaft 13 operates poppet valves in the cylinders connecting cylinder 1 to 2 and cylinder 4 to 3 in the present case of a typical 4-cylinder engine. The overexpansion camshaft 13 is positioned between the intake camshaft 8 and exhaust camshaft 9.

During normal "full load" 4 cylinder operation the normal engine intake and exhaust camshafts 8,9 are operated and the additional 'overexpansion' camshaft 13 is not used. Disabling of the camshaft 13 can be done using various existing technologies i.e. shifting the camshaft axially or electric/hydraulically adjusting the cam in such a way the cam is not operating the poppet valves for exhaust gas rerouting to the inner cylinders.

In case of cylinder deactivation, i.e during partial load mode of operation, the exhaust cam shafts 9 will adjust in such a way that the exhaust ports 7 of active cylinders 1,4 are not used anymore. Instead the additional camshaft 13 dedicated for overexpansion is activated now and is operating the additional poppet valves of the overflow ports that are dedicated for routing exhaust gasses from the active (first) cylinders 1,4 into the passive (second) cylinders 2,3. Hence, when cylinder 1 and 4 are running in combustion mode and cylinders 2 and 3 are de-activated, the exhaust gasses of the active cylinders 1,4 are routed to the deactivated cylinders 2 and 3 to allow further expansion of these gasses to gain additional power from the residual (thermal) energy in these gasses that would otherwise be lost in the exhaust system.

Transition between both modes, i.e. full load and partial load, is seamless within one engine cycle as the camshaft operation for the two modes is synced and can be switched using existing camshaft adjustment methods like rotation, axial movement or the like. Exhaust camshaft 9, that is disabled for cylinder 1 and 4, will be fully functional for cylinder 2 and 3 although it may further have a variation on its cam profile for optimized operation depending on engine design and calibration.

'Overexpansion' camshaft 13 is designed in such a way that the popped valves to the overflow channel 12 that connects cylinders 2 and 3 are open during most of the engine rotation except where this is physically not possible close to top-dead-center (TDC) due to restricted space. Using such a cam profile both inner cylinders 2 and 3 are 'virtually' functional as one single cylinder maximizing overexpansion benefit and flow losses can be greatly reduced.

Instead of poppet valves for connecting the passive cylinders 2-3 to act as one combined volume, this may also be achieved by a dedicated slow valve that is optimized for this behaviour. Preferably, during partial load mode of operation, cylinder 2-3 should be working like 'one large cylinder' and therefore flow losses should be minimized between these cylinders. In order to connect the inner cylinders 2,3 in such a way, while maintaining the possibility that these cylinders 2,3 act independently when the engine is running under full load, a dedicated valve of the plunger or rotating valve type may be placed between the two cylinders 2,3. This valve can be operated independently of the camshafts 8,9,13 and does not have to respond within one engine rotation. Valve mechanism can be plunger type of any practical type valve which allows significant gas tightness at 'normal' all-cylinder operation and low gas flow resistance between the deactivated cylinders during 'overexpansion'. Added benefit is a lower flow friction due to a possibly fully open passage to the overflow channel Traditional poppet valves inevitably limit the passage at piston 'top-dead-center' (TDC).

The overflow channels 15 connecting the cylinders are preferably as short and narrow as possible to minimize free-expansion volume losses in the channels. On the other hand, the channels 15 should not be too narrow such that flow resistance will cause losses due to pressure drops during the transfer. There is an optimum cross-sectional diameter that balances the flow resistance losses with the volume expansion losses. In any event a short transfer path is preferred and, hence, according to the invention the overflow channels 15 are placed at the location where the distance between cylinders 1-2,3-4 is shortest, i.e. along the path of shortest distance between these cylinders. The overexpansion camshaft 13 is positioned directly above these channels.

The specific dimensions of the overflow channels 15 may be optimized taking into account flow turbulence as well as thermal and pressure drop. These three aspects can be optimized by balancing overflow channel length, diameter and shape as will now be elucidated along the lines of the present embodiment, having a plane crank standard layout and assuming the following properties:

bore: 90 mm;
stroke: 90 mm;
engine displacement: 2.3 litre;
firing order: 1-3-4-2.

Transferring gasses from the primary cylinder to the over-expansion cylinders causes efficiency losses. These include:

i) free-expansion volumetric losses due to the volume inside the overflow channels and remaining cylinder volume in the overexpansion cylinders;
ii) friction losses;
iii) heat losses causing pressure drops; and
iv) choking flow effects.

Figure 4:
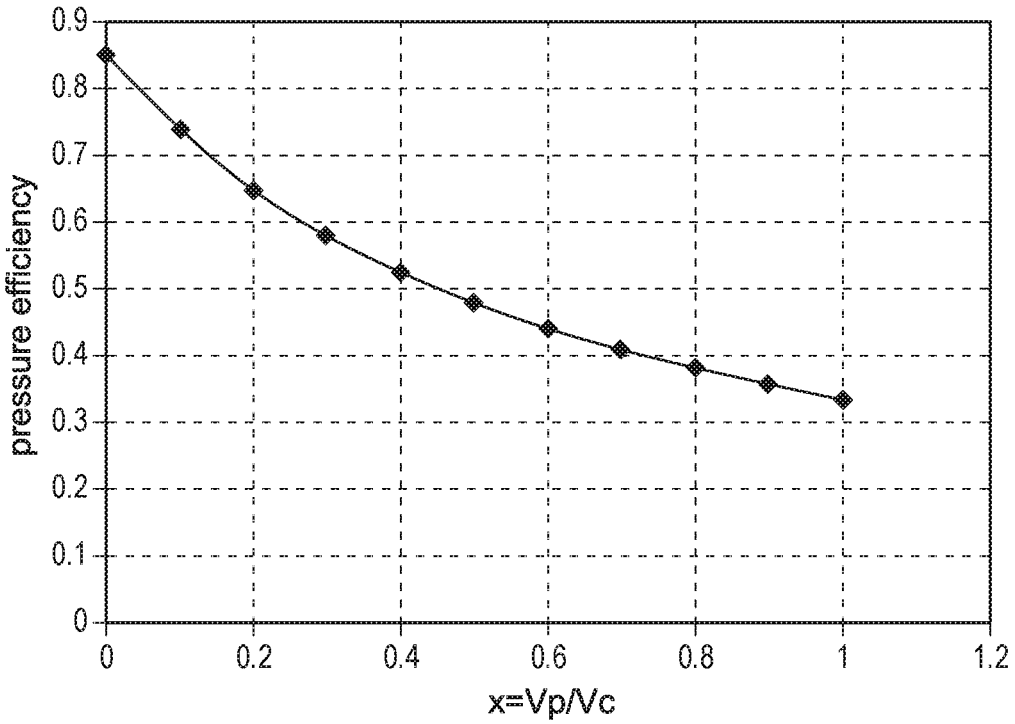
FIG. 4 shows a graph depicting the pressure efficiency against the volume of an overflow channel in the engine of FIG. 2.

In general the top dead centre of the 'passive' cylinders will cause a fixed pressure drop when overexpansion occurs. Depending on the compression ratio of the engine this can fluctuate. Added to this is the volume of the overflow channels, which are also leading to pressure loss as due to free expansion, and therefor this volume is preferably reduced to a minimum, as shown in FIG. 4.

Figure 5:
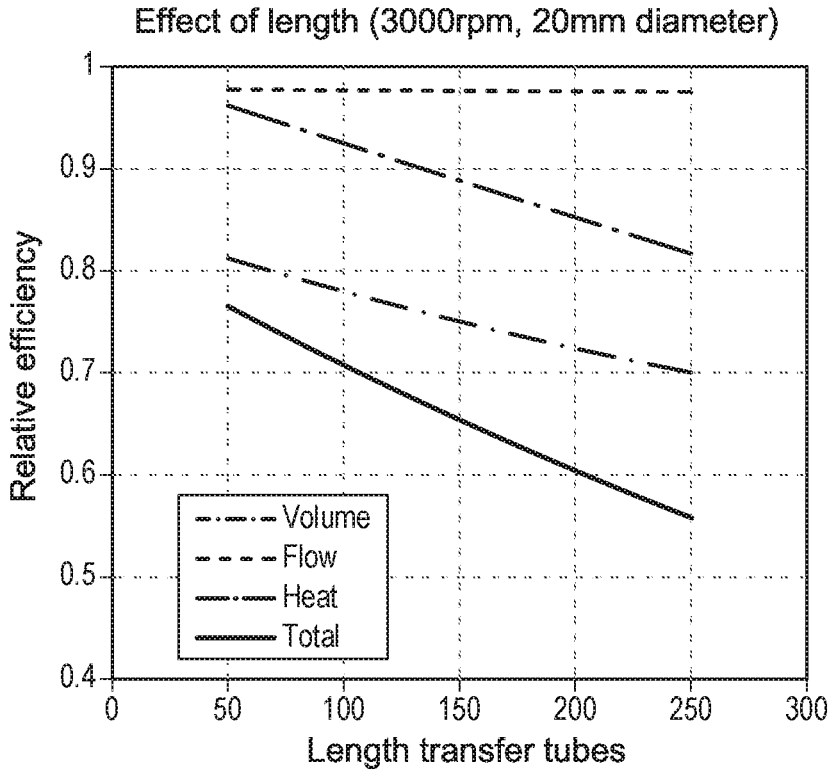
FIG. 5 shows a graph depicting the effect of the length of an overflow channel in the engine of FIG. 2 on the engine efficiency.

When designing transfer channels of length 'L' and diameter 'd', it is, hence, desired to have a length as short as possible while still creating a fluid mechanically efficient passage. A short length will in general lower all losses: volumetric, friction/turbulence and heat, as illustrated by FIG. 5.

Figure 6:
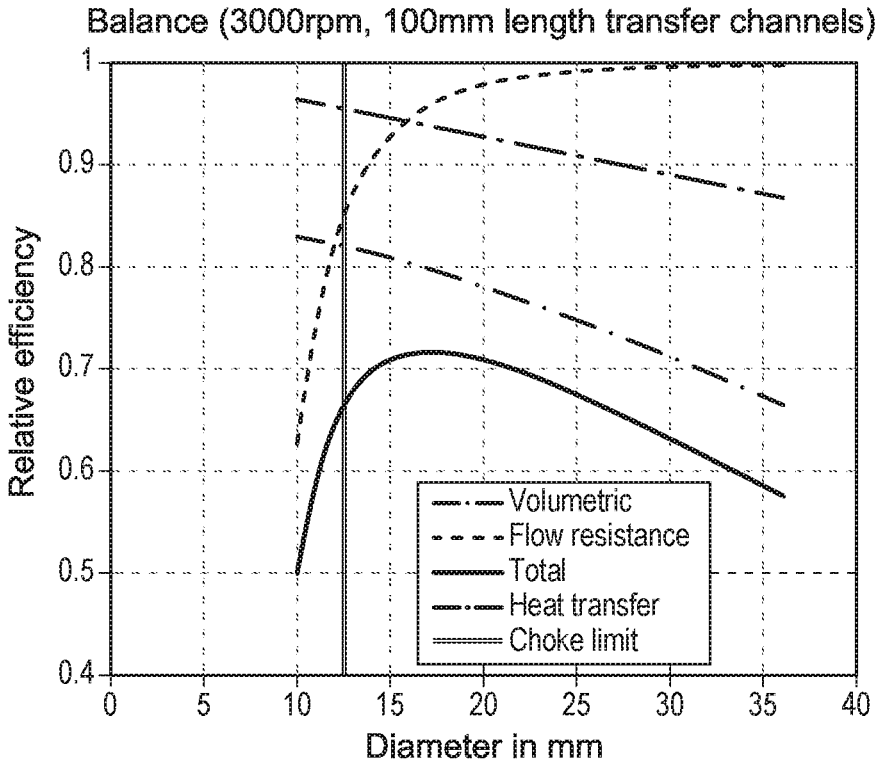
FIG. 6 shows a graph depicting the effect of the diameter of an overflow channel in the engine of FIG. 2 on the engine efficiency.

Also the effect of channel diameter needs to be taken into account. For volumetric losses versus friction losses, there is an optimum to be found as a larger diameter will aid in reducing friction whilst increasing volumetric losses. It should be noticed, however, that for the friction losses, not only the developed pipe flow in the overflow channels need be taken into account, but also inlet and exhaust effects. There are two types of overflow channels in this example, a first type 11 between the active cylinders 1,4 to the de-activated (passive) cylinders 2,3, and another type 12 connecting the expansion cylinders 2,3. At small diameters of the overflow channels also flow choking effects need to be taken into account. When the flow speed reaches the local speed of sound, a choke is created causing a limit on the flow velocity and hence the throughput between cylinders. These effects are assembled in FIG. 6 finding an optimum around the top of the total-curve. In this or similar manner, optimal dimensions of the overflow channels may be found for a particular engine in accordance with i.a. the engine displacement, compression ratio, valve timing and overlap, needed power, rpm range and the type of combustion fuel.

Figure 7:
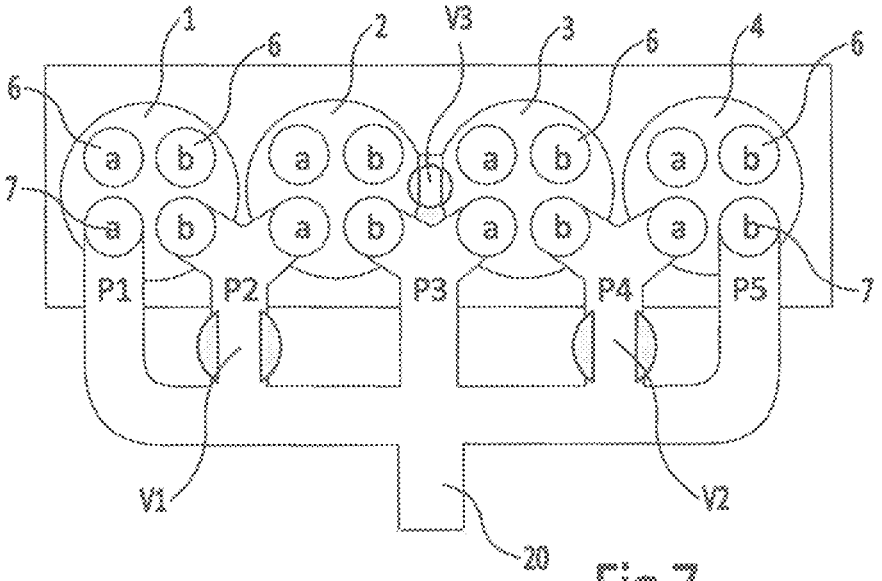
FIG. 7 shows a general design layout of a second embodiment of a combustion engine according to the invention in a full load mode of operation.
Figure 8:
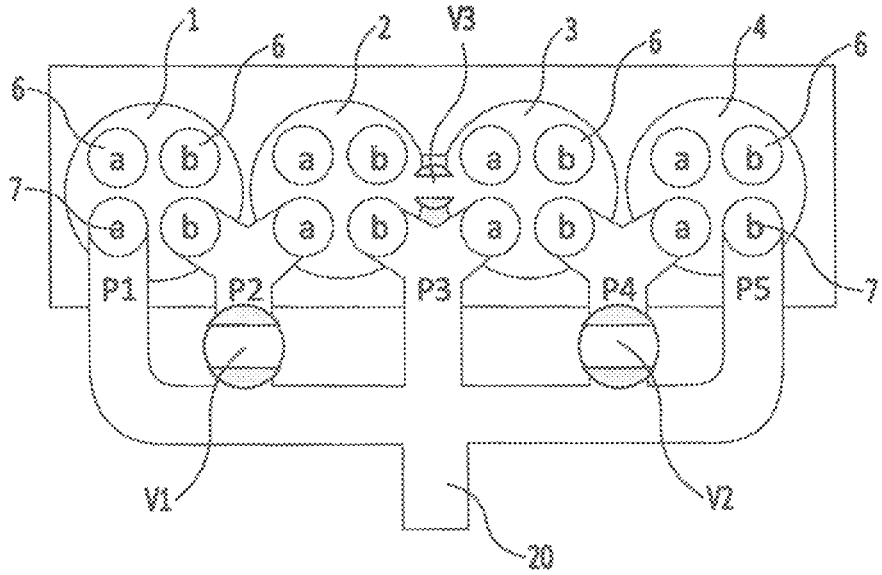
FIG. 8 shows the general design layout of FIG. 7 in a partial load mode of operation.

In a second aspect of the invention overexpansion of the combustion gasses is facilitated in a combustion engine, using the available volume of de-activated cylinders during partial load operation, without the need of dedicated overflow channels. An example thereof is shown in FIGS. 7 and 8. Also in this example a four cylinder inline engine is used for illustration purposes although the same principle may be applied with fewer or more cylinders and with other cylinder layouts.

FIG. 7 shows a 4-cylinder internal combustion engine with a typical firing order of 1-3-4-2, although the firing order may also be different. The outer cylinders are used as primary (first) cylinders that operate under all conditions while the secondary inner (second) cylinders are de-activated during partial load operation of the engine and then provide an overexpansion capability using exhaust routing, the way as described with reference to the first embodiment.

Cylinders 1 and 4 are in phase with each other and both are 180 degrees out of phase with cylinders 2 and 3, which also move together. This is a typical 4-cylinder design. During full load operation, normal 4-stroke operation is performed, where each cylinder has two intake valves 6*a,b* to let air in during the intake stroke and two exhaust valves 7*a,b* to remove the combustion gasses from the cylinders during the exhaust stroke, as represented in FIG. 7.

Camshafts operate the valves 6*a*,6*b*,7*a*,7*b*; typically one camshaft for the intake valves 6*a*,6*b* and one camshaft for the exhaust valves 7*a*,7*b* (DOHC). In a normal 4-cylinder engine, the two exhaust valves 7*a*,7*b* from each cylinder are releasing the gasses into a combined exhaust port, leading to a total of 4 exhaust channels exiting the cylinder head.

In the present example the exhaust header is modified to a peculiar Y-header design. Instead of combining the exhaust valves 7*a*,7*b* of each cylinder into an exhaust port per cylinder that connect to the exhaust channel 20, adjacent exhaust valves 7*a*,7*b* of adjacent cylinders 1-4 are combined into individual exhaust ports P2,P3,P4. This leaves the remaining outer valves 7*a*,7*b* of the outer cylinders 1,4 which get their own individual ports P1,P2. This leads to the configuration of FIG. 7 featuring five exhaust ports P1 . . . P5. The ports have a typical 'Y shape' design for combining said valves. This configuration leads to minimal adjustments needed to the cooling jacket of the cylinder head, whilst maintaining operation of all the exhaust valves during full load operation. The exhaust header comprises external valves V1,V2 that are fully open so that the exhaust capabilities of the engine are fairly uncompromised during this full load mode of operation.

During partial load mode of operation, when the inner cylinders 2,3 are de-activated and allow overexpansion the way described hereinbefore, the external valves V1,V2 in the exhaust header are used to close off port P2 and port P4, see FIG. 8. This can be a plunger valve that falls into a 'seat', minimizing volume losses by effectively reshaping the Y-shape of the port into a flow channel across the cylinders. These valves can be 'slow', i.e. they need not operated within one engine rotation, and do not need to be exactly timed with the camshaft of the engine, making it easier to calibrate and operate. Also, the valves only need to hold the remaining exhaust pressure of the order of 5 bar or less, instead of the full combustion pressure of the order of 100 bars for valves that would be situated inside the cylinders. Port P3 is left open and serves as the exhaust port for the engine in this operating mode.

The exhaust camshaft is modified to a new cam profile by means of an axial shift to adjacent cams. In this mode the exhaust valves 1*a*,7*b* to the individual ports P1,P5 of the outer cylinders 1,4 are not operated anymore. Valves 1*b*+2*a* operate simultaneously to create a overflow channel P2 out of cylinder 1 into cylinder 2 and, likewise, valves 3*b*+4*a* operate simultaneously to create an overflow channel P4 between cylinder 4 and 3. Valves 2*b*+3*a* operate simultaneously to exhaust the combustion gasses after overexpansion through exhaust channel P3.

On the intake camshaft, the intake valves 6 to cylinders 2 and 3 are disabled. A separate slow valve V3 is provided between the inner cylinders 2 and 3 in order to let them communicate flow-wise. This can be, for example, a rotating cylindrical pin with a slot in it, positioned horizontally between the cylinders in the head or a plunger type valve as used in the exhaust header. This valve V3 sits in an overflow channel that connects cylinders 2 and 3 in such a way that they act functionally as one large volume. A rotation or translation can open a slot that creates a short passage between the two cylinders.

Although the invention has been described with reference to merely a few exemplifying embodiments it will be understood that the invention is by no means limited to these examples. On the contrary many modifications and variations are feasible to a skilled person without requiring him to depart from the scope and spirit of the present invention. As such the preceding embodiments focus on a 4-cylinder engine, however the same or similar principle would also work on other internal combustion engine configurations, such as two, six and eight cylinders, whether placed inline, in a V-configuration or opposite one another.

In order to optimize the flow, intake valves of the cylinders on the engine are typically not opened right at a top or bottom dead centre, but slightly before that. In the case of overexpansion, also the transfer between the combustion cylinders and over-expanding cylinders is important. In that respect it is beneficial to have a crank shaft with a crank angle difference between the working and idle cylinders different to exactly 180 degrees, as would be standard for an in-line four cylinder engine. This difference might be of the order between a few degrees and 20 degrees, either in a positive or negative direction. This will allow the expanding gas to use more of the over-expansion stroke and will be beneficial for the overall efficiency in overexpansion mode that might even over-compensate for a slight efficiency loss at full power. An optimized valve timing would for example be late opening of the exhaust compared to default, and synchronized opening of the intake of the over-expansion cylinders. This could also be a larger crank angle where the intakes of the over-expanding cylinders are open.

Hot exhaust gas re-circulation may be achieved by adjusting the valve timing such that some of the exhaust gas is re-introduced back into the firing cylinders. This saves a need for a more complex external re-circulation loop. Variants are an early closure of the exhaust valve(s), different closure timing for the intake valve(s) of the over-expanding cylinder(s), use of crank angle adjustments or a combination of these.

Also the switching mechanism of the engine between direct exhaust and exhaust via a longer channel may beneficially be used by a motor management system that favours running the gasses through these longer channels during heat up. The added value is lower emission due to significantly increased heat-up, and the avoidance of EGHRC (Exhaust Gas Heat Recovery/Recirculation and Cooling) or other systems to heat up the engine actively or passively.

Specific use of compressor means in the over-expansion mode can greatly enhance the power output of the engine in this mode due to higher inlet pressure provided for by the compressor means. A compressor results in a higher rest pressure after a power stroke, which may still be gained in over-expansion mode of the engine. It should be noted that these compressor means preferably are not a standard turbo as turbo's are normally driven by the exhaust gasses and thus do not have this same effect as they are in a way competing for the exhaust gas energy with overexpansion according to the invention.

More in general the invention relates to any and all embodiments that are within the scope or spirit of the following claims.

The invention claimed is:

1. Combustion engine, comprising at least a first combustion chamber and a second combustion chamber that are adjacent to one another, said first combustion chamber and said second combustion chamber each having a reciprocating piston, at least one intake port, at least one exhaust port and an overflow port, in which the overflow port of said first combustion chamber and said overflow port of said second combustion chamber are connected with one another through an overflow channel that comprises an overflow valve which closes said overflow channel during a high load mode of operation of said engine and opens said overflow channel during a partial load mode of operation of said engine, characterized in that said overflow port of said first combustion chamber and said overflow port of said second combustion chamber are at least substantially located on a path of shortest distance between said first combustion chamber and said second combustion chamber at positions that straddle said path of shortest distance between said first combustion chamber and said second combustion chamber, and in that said overflow channel extends at least substantially along said path of shortest distance between said overflow port of said first combustion chamber and said overflow port of said second combustion chamber.

2. Combustion engine according to claim 1, comprising a further first combustion chamber and a further second combustion chamber that are similar to said first combustion chamber and second combustion chamber, said second combustion chamber and said further second combustion chamber each comprising a further overflow port, in which the further overflow port of said second combustion chamber and the further overflow port of said further second combustion chamber are connected with one another through a further overflow channel that comprises a valve which closes said further overflow channel during said high load mode of operation of said engine and opens said further overflow channel during said partial load mode of operation of said engine, characterized in that said further overflow port of said second combustion chamber and said further overflow port of said further second combustion chamber are at least substantially located on a path of shortest distance between said second combustion chamber and said further second combustion chamber at positions that straddle said path of shortest distance between said second combustion chamber and said further second combustion chamber, and in that said further overflow channel extends at least substantially along said path of shortest distance between said further overflow port of said second combustion chamber and said further overflow port of said further second combustion chamber.

3. Combustion engine according to claim 1, characterized in that control means are provided that disable a complete opening of said at least one exhaust port of said first cylinder and said at least one intake port of said second cylinder, while activating said overflow valve of said overflow channel between said first cylinder and said second cylinder within one rotation of said engine.

4. Combustion engine according to claim 3, characterized in that said means comprise a first variable cam shaft and a second variable cam shaft, in that the intake ports of said first combustion chamber and said second combustion chamber comprise timed valves, in particular poppet valves, that are activated within one engine rotation and are controlled by said first variable cam shaft, and in that the exhaust ports of said first combustion chamber and said second combustion chamber comprise timed valves, in particular poppet valves, that are activated within one engine rotation and are controlled by said second variable cam shaft.

5. Combustion engine according to claim 4, characterized in that said overflow valve of said overflow channel comprises a poppet valve that is actuated by a further variable cam shaft.

6. Combustion engine according to claim 2, characterized in that said overflow valve of said further overflow channel comprises a slow valve, in particular a plunger or rotating type valve, that is activated or de-activated over consecutive engine rotations.

7. Combustion engine, comprising at least a first combustion chamber and a second combustion chamber, said first combustion chamber and said second combustion chamber each having a reciprocating piston, an intake port and an exhaust port, in which the exhaust port of the first combustion chamber and the exhaust port of the second combustion chamber communicate with an exhaust header of said engine through respective exhaust channels, characterized in that said first and second combustion chamber each comprise a further exhaust port, said further exhaust port of said first combustion chamber and said further exhaust port of said second combustion chamber communicate jointly in a common exhaust channel, and in that said common exhaust channel communicates with said exhaust header through valve means that open during a high load mode of operation of said engine and close during a partial load mode of operation of said engine.

8. Combustion engine according to claim 7, comprising a further first combustion chamber and a further second combustion chamber that are similar to said first combustion chamber and said second combustion chamber, characterized in that an exhaust port of said second combustion chamber and an exhaust port of said further second combustion chamber communicate together in a further common exhaust channel that connects to said exhaust header of said engine.

9. Combustion engine according to claim 8, characterized in that said second combustion chamber and a further second combustion chamber are connected with one another through an overflow channel that comprises a valve means that close said overflow channel during said high load mode of operation of said engine and that open said overflow channel during said partial load mode of operation of said engine.

10. Combustion engine according to claim 9, characterized in that said overflow channel extends at least substantially along a path of shortest distance between said second combustion chamber and said further second combustion chamber.

11. Combustion engine according to claim 9 characterized in that said valve means of said overflow channel comprise a slow valve, in particular a plunger or rotating type valve.

12. Combustion engine according to claim 7, characterized in that the intake ports of said first combustion chamber and said second combustion chamber comprise timed valves, in particular poppet valves, that are activated within one engine rotation and are controlled by a first variable cam shaft, and in that the exhaust ports of said first combustion chamber and said second combustion chamber comprise timed valves, in particular poppet valves, that are activated within one engine rotation and are controlled by a second variable cam shaft.

13. Combustion engine according to claim 7, characterized in that said valve means between said common exhaust channel and said exhaust header comprise a slow valve, in particular a plunger or rotating type valve.

14. Combustion engine according to claim 1 or 7, characterized in that said at least one first combustion chamber and said at least one second combustion chamber are driving a common crank shaft, and in that a crank angle difference is imposed between a point of engagement of the piston of said at least one first combustion chamber and a point of engagement of the piston of said at least one second combustion chamber departing from 180 degrees, particularly departing up to 20 degrees or specifically about 20 degrees in positive or negative direction.

15. Combustion engine according to claim 1 or 7, characterized in that compressor means are provided that provide an elevated intake pressure at the intake port of said first combustion chamber, at least in said partial load mode of operation of the engine.

* * * * *